United States Patent [19]

Wicks, Sr.

[11] 4,400,912

[45] * Aug. 30, 1983

[54] PATIO DOOR AND WINDOW GUARD SYSTEM

[76] Inventor: Jerome L. Wicks, Sr., 3401 Rockdale Ct., Baltimore, Md. 21207

[ * ] Notice: The portion of the term of this patent subsequent to Apr. 20, 1999 has been disclaimed.

[21] Appl. No.: 330,947

[22] Filed: Dec. 15, 1981

[51] Int. Cl.[3] ..... E06B 3/68

[52] U.S. Cl. ..... 49/57; 49/56

[58] Field of Search ..... 49/56, 57, 50

[56] References Cited

U.S. PATENT DOCUMENTS 1,634,843 7/1927 McWane ..... 49/56

4,325,203 4/1982 Wicks ..... 49/57

*Primary Examiner*—Kenneth Downey

*Attorney, Agent, or Firm*—John F. McClellan, Sr.

[57] ABSTRACT

Improvement in an inside-installation system for barring intruders from access through an opening such as a patio door opening, said system of the type having a series of swinging, slidable rods suspended from an over-head track and held in spaced array by a bar held in brackets at the ends with pin securance at one end and padlock securance at the other; the improvement comprising: two or more bars engaged by a headed pin with a hole for padlocking near the head so that a bar can be captured between head and hole and locked, providing a fast, secure lock for the whole system, with quick release, and providing manufacturing simplicity and improved security.

3 Claims, 1 Drawing Figure

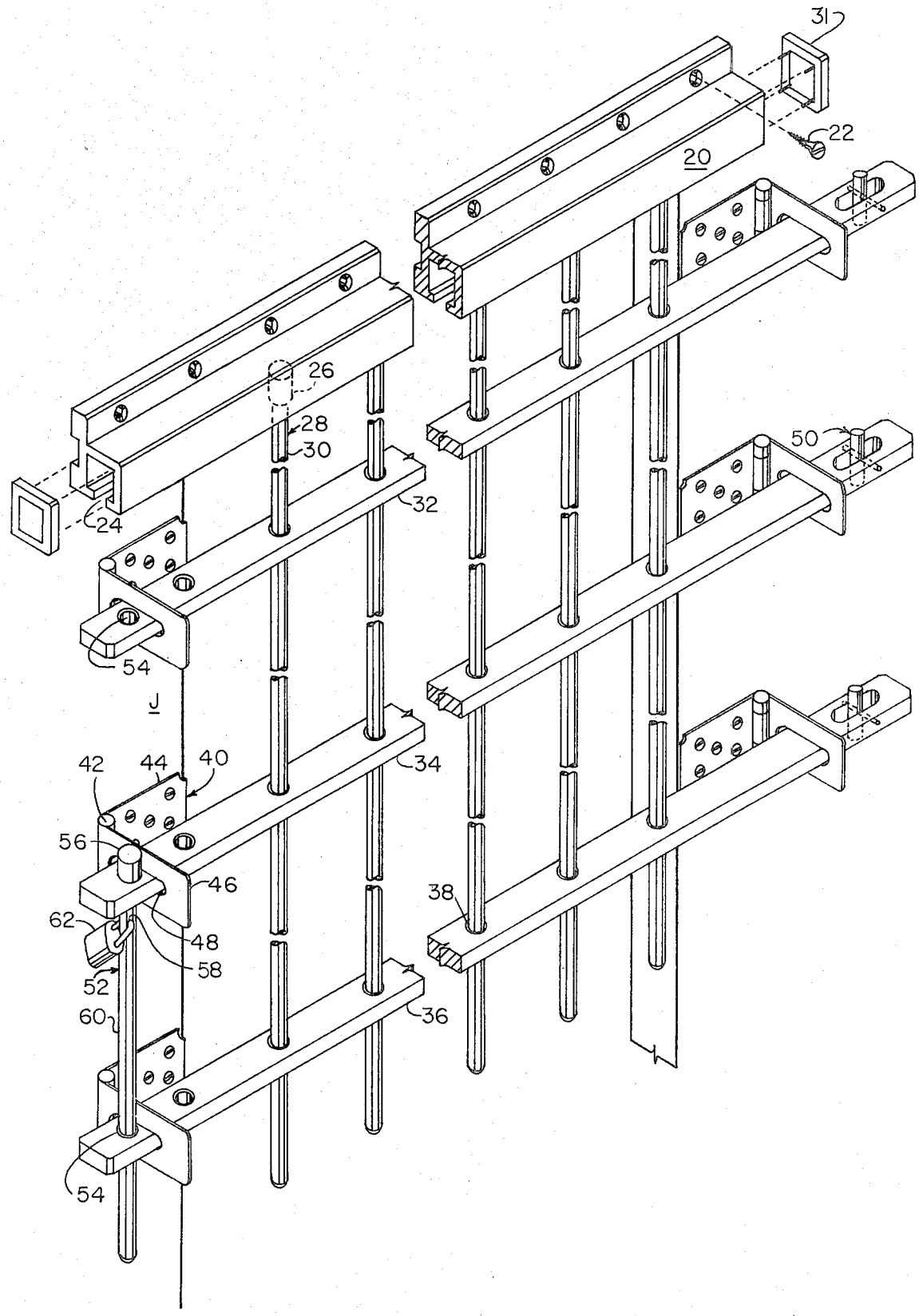
31
22
20
26
28
30
50
32
24
54
J
42
44
40
34
56
46
38
62
48
58
52
60
36
54

PATIO DOOR AND WINDOW GUARD SYSTEM

CROSS-REFERENCE TO AND INCORPORATION OF RELATED APPLICATION

Cross reference is made to my co-pending application Ser. No. 144,951 filed Apr. 29, 1980 for PATIO DOOR AND WINDOW GUARD SYSTEM now U.S. Pat. No. 4,325,203, which is incorporated and made a part hereof.

FIELD OF THE INVENTION

This invention relates generally to protective devices and specifically to physical bars to entry through doors and windows.

CO-PENDING APPLICATION DISCLOSURE

My co-pending application discloses a system primarily for inside installation, having a bottom-side-slotted track across the top of a door or window opening in which a plurality of rods having integral enlarged upper ends slidably retained in the track protrude in free-swinging manner through the slot, with axial movement of the rods provided also.

The rods are held in parallel-spaced position across the opening by a perforate horizontal bar in which the lower ends of the rods can be inserted and the bar slid up to an intermediate position supporting the middle of the rods. A fastening of the bar is provided at one end by a hinged-bracket-engaging free pin or by a pivoted pin, and at the other end by a padlock passed through an opening in that end of the bar when that end of the bar is passed through aligned holes in the legs of a fixed "U" shaped bracket secured to the wall alongside a patio door.

The bottom of the rods are secured in an upward slot in a channel or sill affixed as to the floor of a room.

PRESENT INVENTION

The present invention eliminates the slotted channel or sill while retaining the inside installation advantages enabling it to meet community restrictions against exterior grating systems. Instead it employs a plurality of vertically-spaced vertically perforate horizontal bars which are similar to that of the co-pending application disclosure, with the rods passing through respective perforations in each.

These bracket-supportable bars are secured at one end by bracket-and-pin arrangements like those described and at the other end are locked by a vertical pin having at one end an enlarged head and a hole through the vertical pin in a location spaced slightly below the head. This permits the vertical pin to be run through holes in more than one horizontal bar and secure them, the bars first being passed through respective hinge brackets so that the pin-engaging holes are outside the hinge brackets. The padlock secures immediately below a bar with the pins enlarged head immediately above the bar.

Other provisions of the invention are substantially the same as disclosed in my copending application.

The new provisions provide unobstructed sill, a quick release of more than one bar at a time, greater security and more economy through use of similar parts.

BRIEF DESCRIPTION OF THE DRAWING FIGURE

The FIGURE shows in perspective view fragmentary and partially sectional details of the invention making up an overall view of it.

DETAILED DESCRIPTION

The FIGURE shows the overhead track 20 with screw-attachment 22 for wall engagement over a patio door opening 0.

A downward slot 24 in the track 20 permits the enlarged heads 26 of rods 28 to be slidably captured while the bodies 30 of the rods protrude downward through the slot. Space above the rod heads permits axially upward movement for easy assembly to several bars at once, the bars being described below, and the clearance is such that the rods can be swung freely.

Friction end-clips 31 prevent the rods from sliding out of the track 20 when the bars are being assembled or are disassembled, and the rods are slid to a side for unobstructed view through the door or window.

The rods 28 are held in spaced-array when desired by a matched set of detachable bars 32, 34, 36 (three shown as an example). Each bar has a series of perforations 38 for slidably receiving the rods; all bars are alike. The topmost bar 32, demonstrates a feature of the invention in that it may be locked in place although free of the lock provisions to be described.

Each rod may be held at each end of a respective bracket 40 which may be hinged as at 42 connecting a part 44 screwed to a jamb "J" with a pivotal part 46 having a slot 48 for receiving a bar. The brackets or bar receptacles 40 may be folded flat when not in use.

When the bars are inserted in the brackets, the ends outboard of the brackets may have respectively at one end a pivotal pin 50 and at the other end a vertical, headed pin 52 long enough for insertion in holes 54 in two or more bars at once, with one bar captured between the head 56 and the padlock hole 58 provided in the headed pin shank 60. Padlock 62 then secures the whole assembly in place by engaging hole 58.

It will be appreciated that both my systems force a would-be intruder first to break glass or otherwise to break open a patio door with the attendant noise and danger to himself before reaching the real problem, the interior grating system.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent:

1. In an interior-type system for barring intruder-access through an opening such as a patio door opening, and including an overhead track with a slot, a plurality of headed rods depending from said track through said slot, means for locking said plurality of headed rods including detachable horizontal bar means for sliding up said plurality of headed rods and holding the plurality of headed rods in spaced array across said opening by means of a plurality of rod-receiving perforations in said detachable horizontal bar means, and a bracket supporting each horizontal bar end with a padlock on a said bar end for engaging a said bracket, the improvement comprising: said means for locking including a plurality of said detachable horizontal bar means, and a vertical pin having means for detachably locking together said plurality of detachable horizontal bar means.

2. In a system as recited in claim 1, said detachable vertical pin having a headed end and a shank with a hole therein adjacent the headed end for securing a padlock in position holding a said detachable horizontal bar means therebetween.

3. In a system as recited in claim 2, a said detachable horizontal bar means, in addition to said plurality of detachable horizontal bar means, engaging a plurality of said headed rods and having a said bracket at each end, but free of said vertical pin.

* * * * *